US006405490B2

(12) United States Patent
Nakamoto et al.

(10) Patent No.: US 6,405,490 B2
(45) Date of Patent: Jun. 18, 2002

(54) DOUBLE HINGED DOOR SYSTEM

(75) Inventors: Yusho Nakamoto; Katsunori Sako; Kiminori Kubo, all of Hiroshima (JP)

(73) Assignee: Kabushiki Kaisha Juken Sangyo, Hatsukaichi (JP)

( * ) Notice: Subject to any disclaimer, the term of this patent is extended or adjusted under 35 U.S.C. 154(b) by 0 days.

(21) Appl. No.: 09/756,069

(22) Filed: Jan. 8, 2001

(30) Foreign Application Priority Data

Apr. 17, 2000 (JP) ..... 2000-115675

(51) Int. Cl.[7] ..... E06B 3/00
(52) U.S. Cl. ..... 49/501; 292/244
(58) Field of Search ..... 49/501, 503, 504; 292/244

(56) References Cited

U.S. PATENT DOCUMENTS 4,390,197 A * 6/1983 Butts ..... 292/144
4,583,382 A * 4/1986 Hull ..... 70/107
4,674,776 A * 6/1987 James ..... 292/40
5,083,122 A * 1/1992 Clark ..... 340/825.32
5,474,348 A * 12/1995 Palmer et al. ..... 292/339
5,678,870 A * 10/1997 Pelletier ..... 292/244
5,779,287 A * 7/1998 Johansson ..... 292/169.14
6,128,933 A * 10/2000 Mirshafiee ..... 70/107

FOREIGN PATENT DOCUMENTS

| | | |
|---|---|---|
| JP | 2000-030671 | 2/2000 |
| JP | 2000-089430 | 3/2000 |
| JP | 2000-240330 | 9/2000 |

* cited by examiner

*Primary Examiner*—Curtis H. Cohen
(74) *Attorney, Agent, or Firm*—Frishauf, Holtz, Goodman, Langer & Chick, P.C.

(57) ABSTRACT

Each of the hinges 30, 30 is positioned at upper and lower positions of the hinge-side vertical member 20 correspondingly, wherein each position is symmetrical relative to the horizontal plane which divides the hinge-side vertical member 20 in halves. A latch hole 52 of the latch receiver 50 is provided at a position of the latch-side vertical member 25 where the member 25 is divided in halves. A latch 40 is positioned higher than a door handle 90 capable of reversing. Each hinge is attached through one touch operation in order for use in a double hinged door system.

4 Claims, 9 Drawing Sheets

DOUBLE HINGED DOOR SYSTEM

BACKGROUND OF THE INVENTION

1. Field of the Invention

The present invention relates to a double hinged door system. More particularly, the present invention provides a system that comprises a door and a door frame, wherein the door frame comprises a hinge-side vertical member provided with a pair of hinges for holding the door capable of rotating and a latch-side vertical member provided with a latch receiving member for receiving a latch.

2. Description of the Related Art

In general houses, either a left hinged door or a right hinged door is selected to meet a floor plan. The left hinged door is a type where a pair of hinges are attached to the left side of a door, while the right hinged door is that a pair hinges are attached to the right side of the door. Also, two types of door frames are prepared and used to assemble the left hinged and right hinged doors. However, it is inefficient to prepare two types of doors and door frames since there is needed double trouble in production, storage and sale.

To overcome such drawback, the applicant of the present invention invented a door structure comprising a door and a door frame and has filed an patent application in Japan (Japanese Patent Application No. 11-046347). This invention is such that a latch can be positioned at the mid-height of a door without moving a door handle in a vertical direction. According to this invention, a door and a door frame can be utilized for both a left hinged and right hinged door systems.

However, a latch assembled to this door could not correspond to this system because of its figure. Therefore, it is convenient if a latch can be used for both the left hinged and right hinged door systems by simply reversing its posture. Further, it is also convenient if a pair of hinges assembled to the door can be used for both systems.

The applicant of the present invention invented a latch which could be reversed without removing a latch apparatus from a door and has filed a patent application (Japanese Patent Application No. 2000-089430). According to this invention, it is easy to reverse the latch since there is no need to remove the apparatus and plates and other parts included in the apparatus, thus improving working property. Further, according to this invention, it is unnecessary to remove the latch apparatus to reverse the latch, so that there is no need to screw the screws to the points where the screws had once been fastened thereto and have been unfastened to remove the apparatus, so that the screws will not be loosened for that reason, and thus the function of the apparatus will improve. It is economical that only a single plate is required in this invention.

The applicant of the present invention invented a hinge used for both a left hinged and right hinged door system through one touch operation and has filed a patent application for this invention (Japanese Patent Application No. 2000-030671). According to this invention, the hinge can be assembled to a door both from the front and back sides of the door for any number of times through one touch operation, so that it can be used for both the left hinged and right hinged door systems for demands in the fields. Further, in this invention, there is no need to fasten or unfasten wood screws to replace the hinge from the front side to the back side of a door and vice versa, thus an assemble operation becomes easy. And, a demerit of the wood screws, that is a deterioration of holding capability. e.g., becomes no drawback.

Further, it is possible to package the parts in separation, so that they are prevented from being deformed or damaged by a outer mechanical shock during transportation, and that they are maintained in a stable posture during transportation. Furthermore, no extra cushion materials are needed, so that a cost for packaging and transportation is saved.

Therefore, an object of the present invention is to provide a double hinged door system in which a structure of a door and door frame, both used for a left hinged and right hinged door systems, is combined with a latch and a pair of hinges, both of which are also used in the left hinged and right hinged door systems, providing a new system.

SUMMARY OF THE INVENTION

A double hinged door system according to a first aspect of the invention comprises a door 10 having a latch driving apparatus 15 which converts a rotation movement of an axis 91 of a door handle 90 into a forward-and-backward movement of a latch 40; and a door frame having a hinge-side vertical member 20 and a latch-side vertical member 25. The hinge-side vertical member 20 is provided with a pair of hinges 30 at an upper and lower portions for holding the door 10 capable of rotating. The latch-side vertical member 25 is provided with a latch receiving member 50 having a latch hole 52 for receiving the latch 40 projected from the door 10.

Each hinge 30 is positioned symmetrical about the midpoint of the hinge-side vertical member 20, and the latch hole 52 of the latch receiving member 50 is positioned at a point which divides the latch-side vertical member 25 into equal halves.

The latch 40 is arranged capable of rotating and is composed of a front-end member 40F having a large diameter and a rear-end member 40R having a smaller diameter. The latch driving apparatus 15 comprises an upward member 61 projected upward from the axis 91 of the door handle 90; a downward member 62 projected downward from the axis 91 of the door handle 90; a vertical bar 63 attached to the rear-end member 40R of the latch 40 capable of sliding; a horizontal bar 64 which includes a large member 64*a* at its end portion and which is connected with the upward member 61 at the front of the large member 64*a* and is also connected with the bottom end portion of the vertical bar 63 at the front portion thereof; a first spring 66 which is sled onto the horizontal bar 64 in between the upward member 61 and the vertical bar 63, and which pushes the vertical bar 63 in the forward direction, projecting the front-end member 40F of the latch 40 out of the door 10; and a second spring 65 which pushes the upward member 61 in the rear direction, returning the door handle 90 to the home position.

The latch 40 is positioned at the level of the latch hole 52 and higher than the axis 91, and is provided with a concave 40*a* at the front-end member 40F, and is also provided with a thick portion 40*b* at the rear-end member 40R. A reversing spring 71 with a greater elastic force than the first spring 66 is sled onto the latch 40 in between the thick portion 40*b* and the vertical bar 63. The rear-end member 40R of the latch 40 is pulled out of the door 10 against the elastic force of the reversing spring 71 as a stick 95, e.g., a screwdriver is pulled after it is inserted into the concave 40*a*, and then the latch 40 is reversed from side to side, and subsequently the latch 40 returns into the door 10 in a reversed posture by an elastic force of the reversing spring 71 as the stick 95 is released from the concave 40*a*.

Each hinge 30 comprises a frame-side base member 41, which is attached to a hinge-side vertical member 20, and whose front end is connected with a first plate 31; and a door-side base member 42, which is attached to the edge side of the door 10, and whose front end is connected with a second plate 32. The second plate 32 is removable from the door-side base member 42, and the door-side base member 42 is embedded at the edge of the door-side base member 42 as such that it is symmetrical about the center line of the edge and that it is not projected from the edge forming a flat surface with the edge.

The door-side base member 42 is provided with a slit 44 in the depth (thickness) direction of the door 10, which receives the front end of the second plate 32 from both the front and back sides of the door 10. And a lock apparatus is provided to make an engagement relation with the second plate 32 inserted into the slit 44.

A second aspect of a double hinged door system according to the present invention is characterized in that the rear end of the second plate 32 is attached to the first plate 31 capable of moving upward and downward directions with adjusting screws 36, 37. The front end of the first plate 31 is placed in a long hole 43 of the frame-side base member 41, where the width of the long hole 43 is wider than the thickness of the first plate 31, thus, the first plate 31 is capable of moving in the depth direction of the first plate 31 within the long hole 43. And, the front end of the first plate 31 is connected to the frame-side base member 41 capable of moving closer to and away from the member 41 by fixing an adjusting screw or an adjusting cam 45.

A third aspect of a double hinged door system according to the present invention is characterized in that the second plate 32 is provided with a hole 34 at the center of the front end thereof. The lock apparatus is composed of an elastic projection 48*a*, 48*b* which extends into the hole 34 and engages therewith as the hole 34 comes to the position opposing to the projections 48*a*, 48*b*, while it is compressed otherwise. And, the elastic projection 48*a*, 48*b* is compressed in order to disengage with the hole 34.

According to a first aspect of the present invention, a pair of hinge is provided at an upper and lower portions which are symmetrical about the midpoint of the height of the hinge-side vertical member, and the latch hole is formed at a point which divides the latch-side vertical member into equal halves. Further, the latch is positioned at a level equal to the latch hole but higher than the door handle. Therefore, the levels of the latch driving apparatus and the latch itself are maintained even the door is reversed from side to side. Both the hinge-side vertical member and the latch-side vertical member of a door frame are turned from top to bottom in 180 degrees and are then reversed from side to side, but their heights are maintained the same as in the previous postures.

Further, the latch can be rotated without replacing parts such as a key member and plates. Thus, it is unnecessary to unscrew the fixing screws and re-screw them at the same points in order to reverse the latch, so that the fixing screws are prevented from being loosened. Also, a reversing operation of the latch becomes easy. Further, the latch is quickly reversed to a posture corresponding to a left-hinged door system or a right-hinged door system in the fields.

A combined unit of the first plate, the second plate and the frame-side base member of a hinge is removable from the door-side base member, and the unit can be inserted into the slit formed at the door-side base member from both the front and back sides of the door through one-touch operation for any number of times, so that the hinge can be quickly attached to either a left-hinged door or right-hinged door as desired in the fields. A combined unit of the first plate, second plate and frame-side base member can be packaged while it is removed from the door-side base member, so that it is prevented from being deformed or damaged and stabilized in posture during transportation. Therefore, no extra cushion materials are required during transportation, which can save costs. Further, the door-side base member is embedded in the edge of a door making a flat surface and not projecting therefrom, so that the door can be stabilized during transportation, as well.

As described above, according to the first aspect of the invention, the door, door frame, latch and a pair of hinges are systematized for both a left-hinged and right-hinged doors, so that a double-hinged door system with higher productivity is provided.

According to a second aspect of the present invention in addition to the advantages of the first aspect, a door can be moved to the vertical, horizontal and depth directions while the door is in a closed position by fixing the adjusting screws and adjusting cam, so that it is easy to fine adjust the door when and after the door is attached.

According to a third aspect of the present invention in addition to the first and second advantages of the first and second aspects of the inventions, the lock apparatus is simply structured that it is composed of a elastic projection such as a spring, engaging member or blade spring. Engagement and disengagement operations with this lock apparatus are easily performed by simply extending and compressing the elastic projection.

DESCRIPTION OF PREFERRED EMBODIMENT

Figure 1:
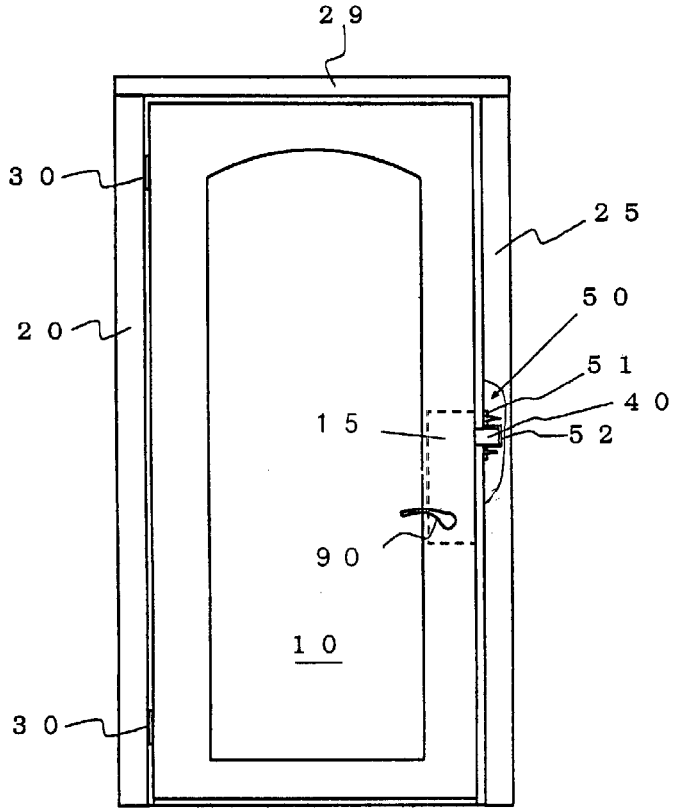
FIG. 1 is an elevation view showing a double hinged door system according to the present invention.
Figure 2:
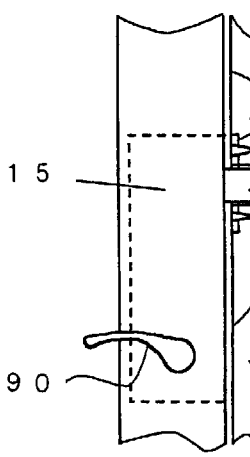
FIGS. 2(*a*) and 2(*b*) are partial sectional views showing a latch driving apparatus in FIG. 1, wherein 2(*a*) shows a left hinged door system, and 2(*b*) shows a right hinged door system.
Figure 2:
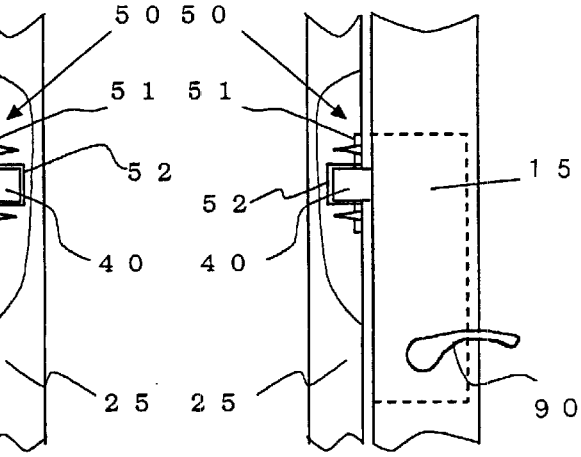
Figure 3:
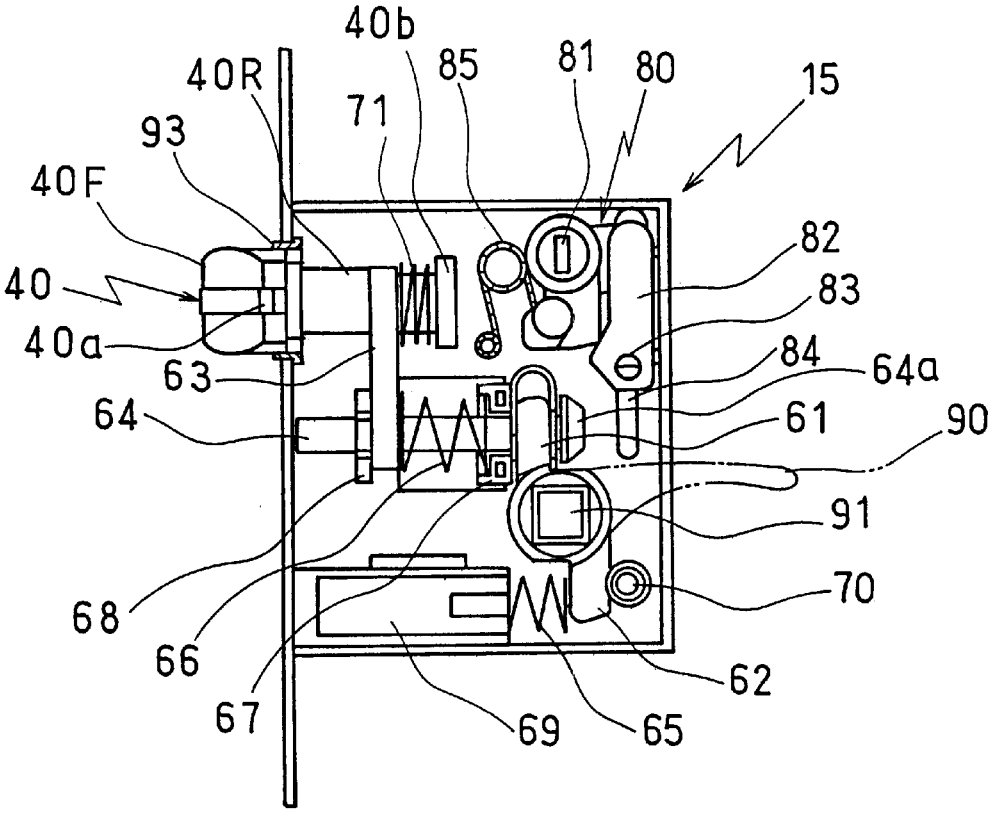
FIG. 3 is a sectional view showing the preferred embodiment of the latch driving apparatus wherein the latch is at the advanced position.
Figure 4:
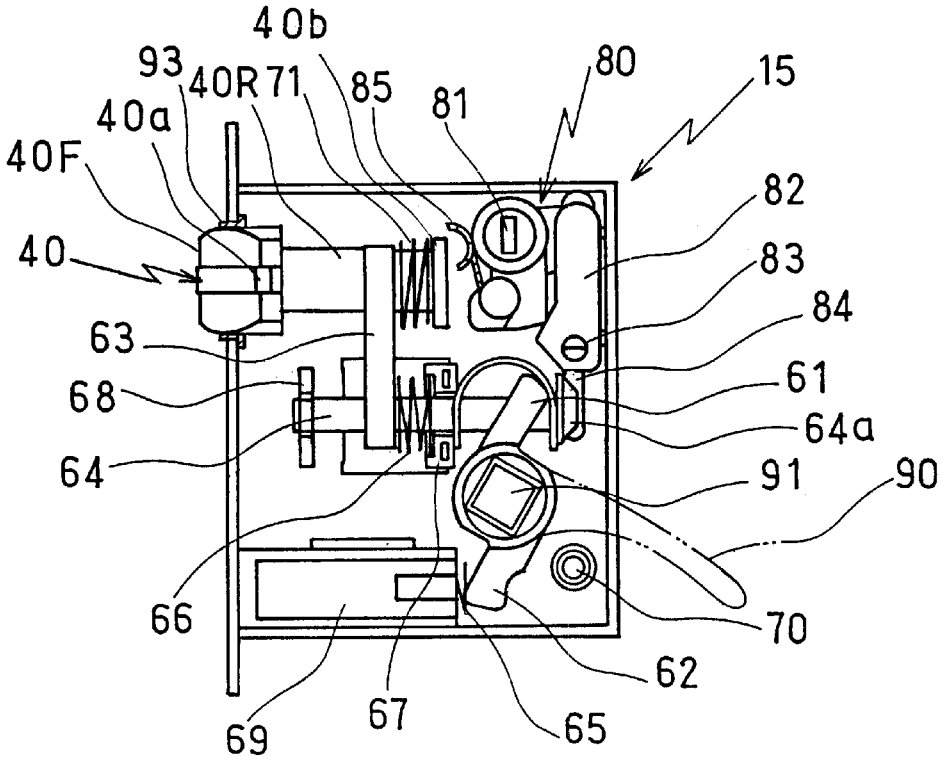
FIG. 4 is a sectional view of the driving apparatus shown in FIG. 3, wherein the latch is at the backdown position.
Figure 5:
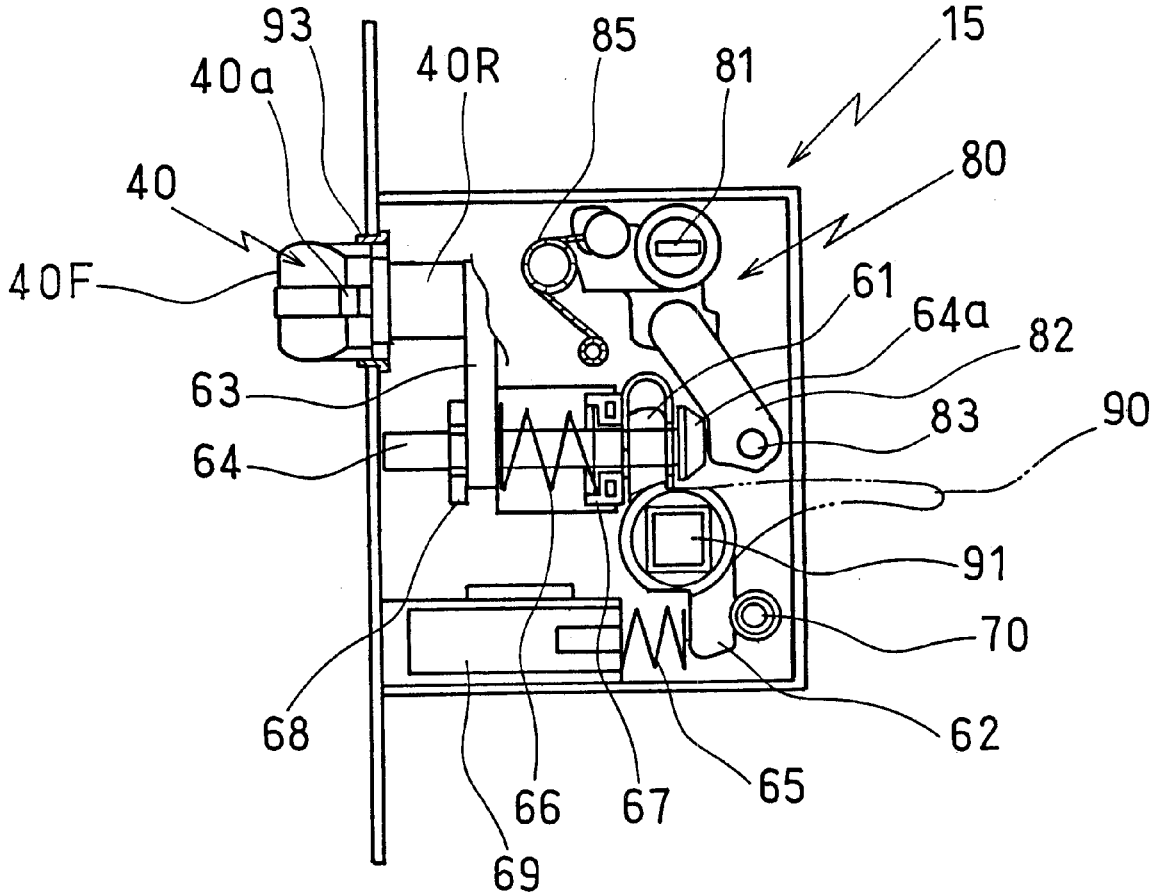
FIG. 5 is a sectional view of the driving apparatus shown in FIG. 3, wherein the latch is locked at the advanced position.

An embodiment of the present invention will be described referring to the drawings. FIG. 1 is an elevation view showing a double hinged door system according to the present invention. FIGS. 2(*a*) and 2(*b*) are partial sectional view showing a latch driving apparatus comprised in the present invention. FIGS. 3, 4 and 5 are sectional views showing the latch driving apparatus, wherein FIG. 3 shows the latch at the advanced position, while FIG. 4 shows the latch at the backdown position and FIG. 5 shows the latch being locked at the advanced position.

(A)

First, a door frame included in a double hinged door system according to the present invention will be described. The door frame comprises a hinge-side vertical member 20 having a pair of hinges 30, 30 in a vertical direction for holding a door 10 capable of turning; a latch-side vertical member 25 having a latch receiver 50 comprising a latch hole 52 at its main body for receiving a latch 40 which projects from the door 10; and an upper member 29 provided between the hinge-side vertical member 20 and the latch-side vertical member 25 at the upend portions thereof.

The door frame is structured such that when the hinge-side vertical member 20 and the latch-side vertical member 25 are reversed 180 degrees both from top to down and side to side, the hinges 30, 30 and the latch receiving portion of the latch receiver 50 come to the level equal to the previous level.

That is, each of the hinges 30, 30 is positioned at upper and lower positions of the hinge-side vertical member 20 accordingly, wherein the positions are symmetrical about the horizontal plane which divides the hinge-side vertical member 20 into equal halves. Further, a latch hole 52 of the latch receiver 50 is formed at the point of the latch-side vertical member 25, which divides the member 25 into equal halves. The latch-side vertical member 25 is equal to the hinge-side vertical member in length. The latch hole 52 is similar to the latch 40 in sectional figure.

(B)

A door 10 included in a double hinged door system according to the present invention will be described. The door 10 is attached to a door frame capable of rotating via a pair of hinges 30, 30, and it comprises a latch driving apparatus 15 which converts the rotational movement of a door handle 90 and an axis 91 thereof into a forward and backward movement. The latch 40 included in the latch driving apparatus 15 is positioned higher than the axis 91 of the door handle 90 but is at the level equal to a latch hole 52 of a latch-side vertical member.

(C)

A latch driving apparatus included in a double hinged door system according to the present invention will be described. The latch driving apparatus 15 comprises an upward member 61 projected upward from an axis 91 of a door handle 90; a downward member 62 projected downward from the axis 91; a vertical bar 63 whose upper-end portion is attached to the rear-end member 40R of a latch 40 capable of moving, thereby a door 10 is used as a double hinged door; a horizontal bar 64 which connects the upward member 61 capable of rotating at the front of the large member 64*a* formed at the down end portion of the bar 64, and which connects the down end portion of the vertical bar 63 at its front portion; a first spring 66 which pushes the vertical bar 63 in the forward direction with its elastic force, thereby projecting a front-end member 40F of the latch 40 out of the door 10; a second spring 65 which pushes the downward member 62 in the backward direction, thereby rotating the upward member 61 in the forward direction and returning the door handle 90 to the home position. The rear-end portion of the first spring 66 is in contact with a fixed member 67, and the front-end portion of the second spring 65 is in contact with a tube case 69.

The latch 40 is capable of rotating, and it comprises a front-end member 40F and a rear-end member 40R, wherein the latter is smaller than the former in diameter. There is provided a concave 40*a* at the front-end member 40F of the latch 40. There is also provided a reversing spring 71 in between a thick member 40*b* formed at the rear-end member 40R of the latch 40 and the vertical bar 63. The elastic force of the reversing spring 71 is greater than that of the first spring 66.

In order to reverse the latch 40, a front edge of a screwdriver 95 should be inserted into the concave 40*a*, and the screwdriver 95 should be pulled until the rear-end member 40R of the latch 40 comes out of the door 10 against the elastic force of the reversing spring 71. Then, the screwdriver 95 should be rotated in a direction that latch 40 is reversed. After the latch 40 is reversed, the screwdriver 95 should be pulled out of the concave 40*a*, thereby allowing the latch 40 to return to the home position with an elastic force of the reversing spring 71 in a reversed posture. Following such procedure, it is easy to reverse the latch 40.

The function of the latch driving apparatus will be more specifically described. When the door handle 90 is in a free position, the upward member 61 is pushed in the forward direction as the downward member 62, which is uniformed with the axis 91 of the door handle 90, is pushed in the downward direction by an elastic force of the second spring 65 (See FIG. 3). In this position, the front-end member 40F of the latch 40 projects out of the door 10 as the vertical bar 63 connected with the horizontal bar 64 is pushed in the forward direction by an elastic force of the first spring 66.

From this position, when the door handle 90 is turned in the clockwise direction to open the door 10, the upward member 61 turns in the same direction, pushing the large member 64*a* of the horizontal bar 64 in the backward direction. Then, the vertical bar 63, which is connected with the horizontal bar 64, moves in the downward direction against the elastic force of the first spring 66 (See FIG. 4). At the same time, the downward member 62 turns in the clockwise direction. By pulling or pushing the door handle 90, the door 10 opens.

After the door 10 is closed and the door handle 90 is released or turned in the counter-clockwise direction, the second spring 65 pushes the downward member 62 in the counter-clockwise direction, and the first spring 66 pushes the vertical bar 63, which is connected to the horizontal bar 64, in the forward direction. Then, the latch 40 moves in the forward direction, projecting itself out of the door 10. The axis 91 also returns to its home position (See FIG. 3). In this position, the latch 40 and the axis 91 are restricted to the present position as the vertical bar 63 hits a stopper 68 while the downward member 62 hits a stopping projection 70.

The latch driving apparatus 15 included in the preferred embodiment of the present invention comprises a lock apparatus 80 (See FIG. 5). In this lock apparatus 80, by turning a rotary member 81 in the clockwise direction, a key member 82 slides down and the bottom portion thereof comes to the back of the horizontal bar 64. The key member 82 slides down accurately as a projection 83 projected from the key member 82 is inserted in and guided by a guide hole 84. If the door handle 90 is turned in the clockwise direction, while the key member 82 is moved down and is at the lock position, the horizontal bar 64 is restricted to move, and the latch 40 is kept in a lock position. Both the lock position and unlocked position of the key member 82 are maintained by an elastic force of a spring member 85.

The door system illustrated in FIG. 1 and FIG. 2(*a*) has a pair of hinges attached at the left side of the door. This left hinged door system will be reversed to a right hinged door system, as illustrated in FIG. 2(*b*), following the process described below.

To reverse the door system, both a hinge-side vertical member 20 and a latch-side member 25 of a door frame should be turned upside down, then their positions should be reversed from side to side, that is, the hinge-side vertical member 20 should be moved from the left to the right while the latch-side vertical member 25 be moved from the right to the left. Also, a door 10 should be reversed from side to side. Then, the front edge of a screwdriver 95 should be inserted into a concave 40*a*, pulling the latch 40 outward for a certain length against an elastic force of a reversing spring 71 until the rear-end member 40R comes out of the door 10 (See FIG. 6(*a*)).

Figure 6:
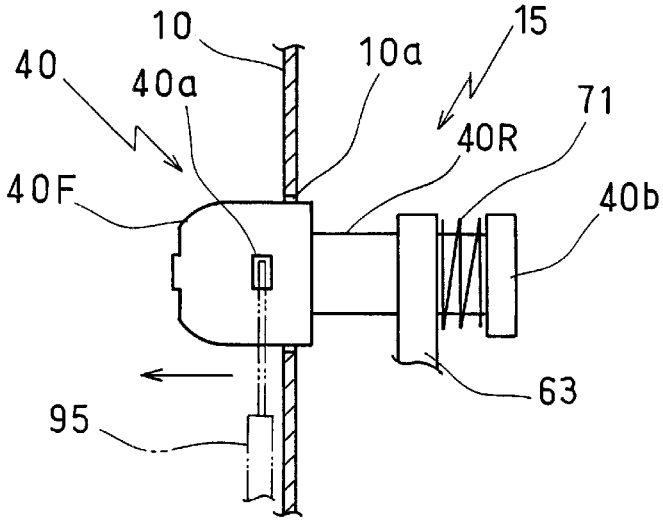
FIGS. 6(*a*)–6(*c*) are a schematic sectional views of the latch driving apparatus shown in FIG. 3, showing a reversing operation of a latch.
Figure 6:
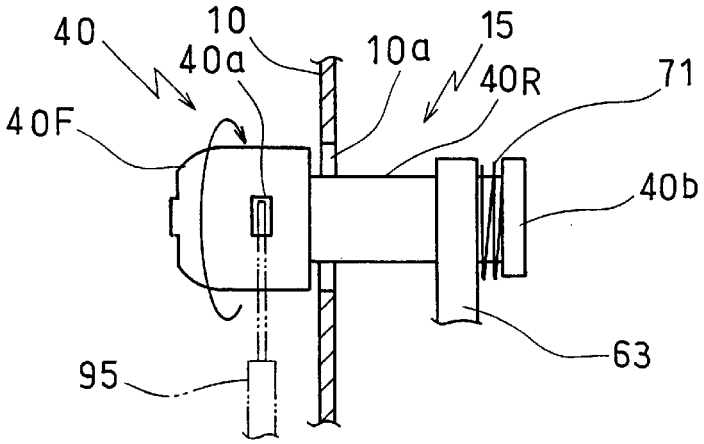
Figure 6:
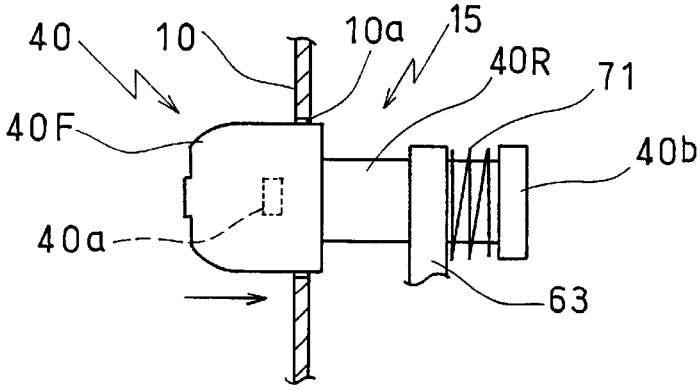

Subsequently, the latch 40 is to be reversed 180 degrees (FIG. 6(*b*)). In this position, the latch 40 can be reversed since the rear-end member 40R of the latch 40 is smaller than the front-end member 40F in diameter, so that the rear-end member 40R, which is pulled out and takes a positions in a latch hole 10*a*, can rotate in the latch hole 10*a* or a cover 93 of the hole 10*a*. Before the latch 40 is pulled out of the door 10, the front-end member 40F, which takes a position in the latch hole 10*a* or in the cover 93, cannot rotate in the latch hole 10*a* or the cover 93, since the diameter of the front-end member 40F is too large to rotate. Some doors have the covers 93 for the latch holes 10*a* and some others do not.

Subsequent to this, the screwdriver 95 should be removed. Then, the latch 40 returns to its home position by an elastic force of the reversing spring 71 (FIG. 6(*c*)). In this preferred embodiment, there is used a pair of hinges 30 which can be applied to both the left hinged door system and right hinged door system. A hinge 30 set for a use in the left hinged door system, for example, can be used in the right hinged door system, and vise versa. The door frame, door 10, latch driving apparatus 15 and hinges 30 are applied for both the left and right hinged door systems, thus it is unnecessary to produce two types of parts for a left hinged and right hinged door systems. This leads to better productivity.

(D)

Figure 7:
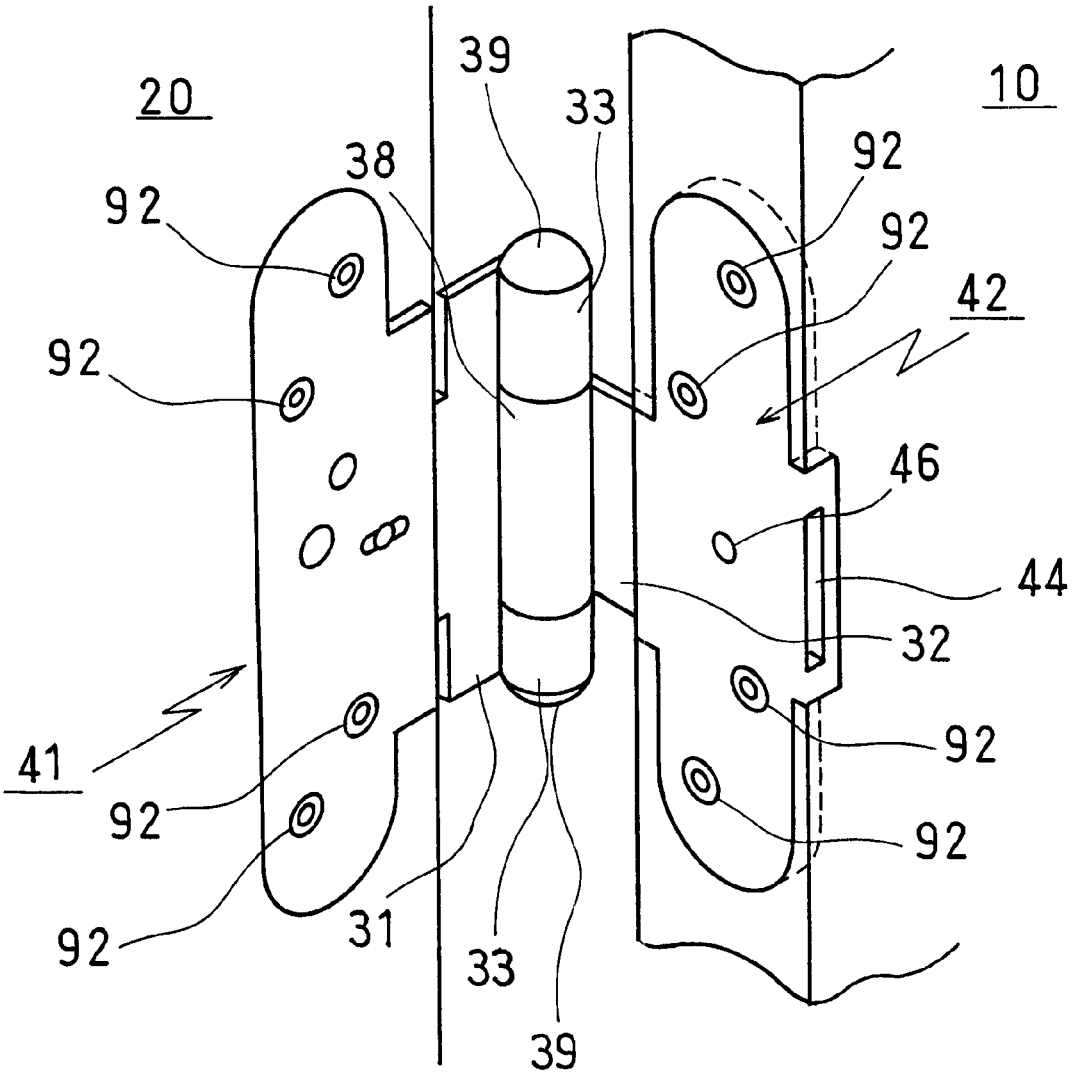
FIG. 7 is a perspective view showing a hinge included in a preferred embodiment of the present invention.

A pair of hinges 30 included in the preferred embodiment according to the present invention will be described. Each hinge 30 comprises a first plate 31 and a second plate 32, the rear ends of which are connected with each other capable of rotation forming a hinge structure; and a frame-side base member 41 and a door-side base member 42, to which the front ends of the first plate 31 and the second plate 32 are connected, respectively. As shown in FIG. 7, the frame-side base member 41 is attached to the hinge-side vertical member 20, while the door-side base member 42 being attached to the edge portion of the door 10.

The hinge 30 will be further described in detail. The door-side base member 42 is symmetrical about the center of the depth (thickness) of the door 10 (which is a width between the front side and back side of the door 10), and it is flatly embedded on the side edge of the door 10 as such that it is not projected from the side edge of the door 10. The member 42 is fixed to the side edge of the door 10 with a plural number of nails 92. The width (the maximum width) of the door-side member 42 is equal to the thickness of the side edge of the door 10, and the member 42 is arranged not to project from the side edge of the door 10 toward the hinge-side vertical member 20.

Figure 8:
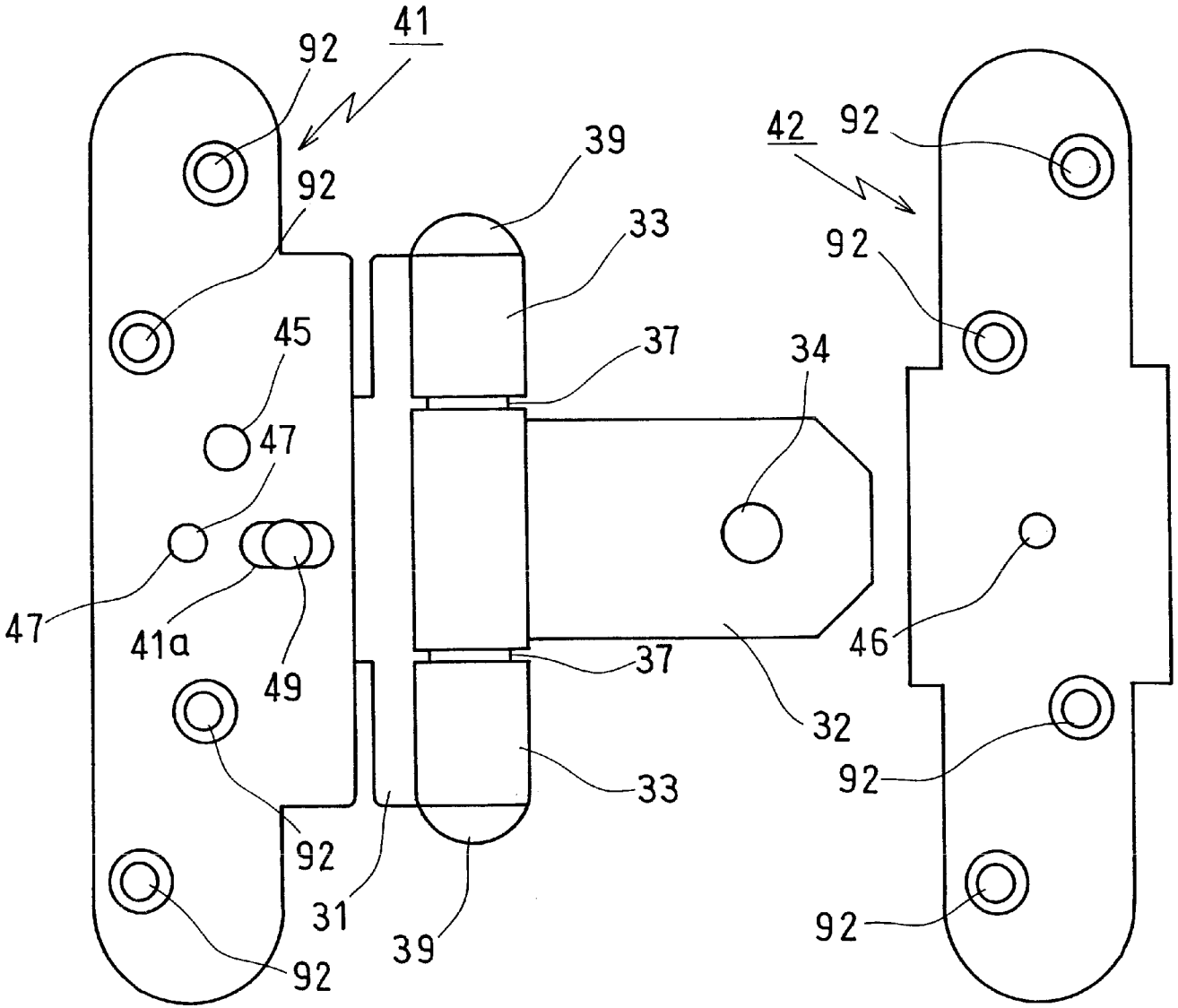
FIG. 8 is an elevation view of a hinge shown in FIG. 7, wherein a second plate is about to be inserted into a hole of a door-side base member.

There is provided a slit 44 at the center of the door-side base member 42, which passes through the member 42 in the directions along the thickness of the door 10. The front end of the second plate 32 can be inserted into the slit 44 both from the front side (the right side in FIGS. 8 and 9) and back side (the left side in FIGS. 8 and 9) of the door 10. Further, there is provided a lock apparatus, which engages with the second plate 32 inserted in the slit 44. There may be provided a cap (not shown in the drawings) for covering a mouth of the slit 44 opened on the other side of the mouth into which the second plate 32 is inserted.

Figure 10:
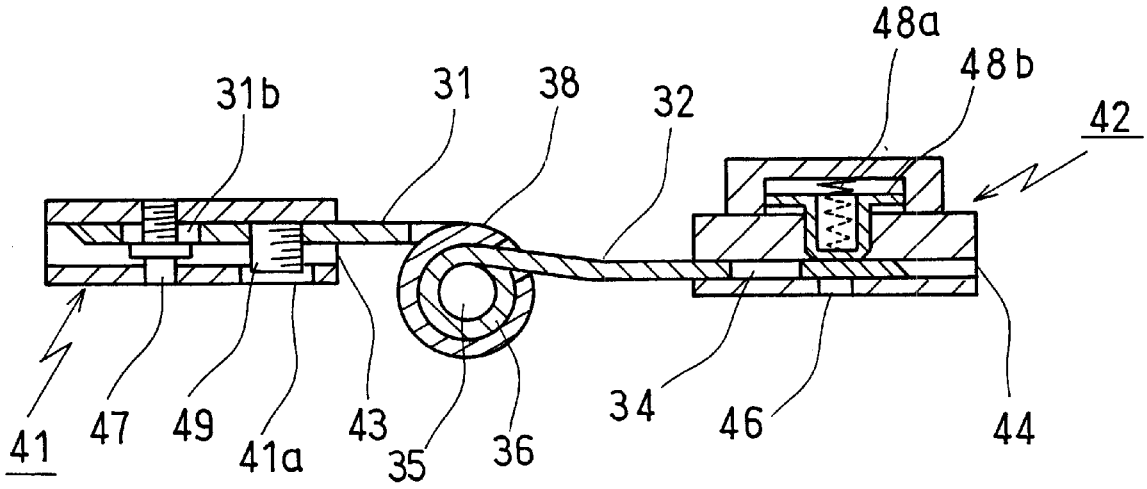
FIG. 10 is a sectional view of a hinge shown in FIG. 7 along line A—A in FIG. 9, wherein a second plate is about to be engaged with a hole of a door-side base member.
Figure 11:
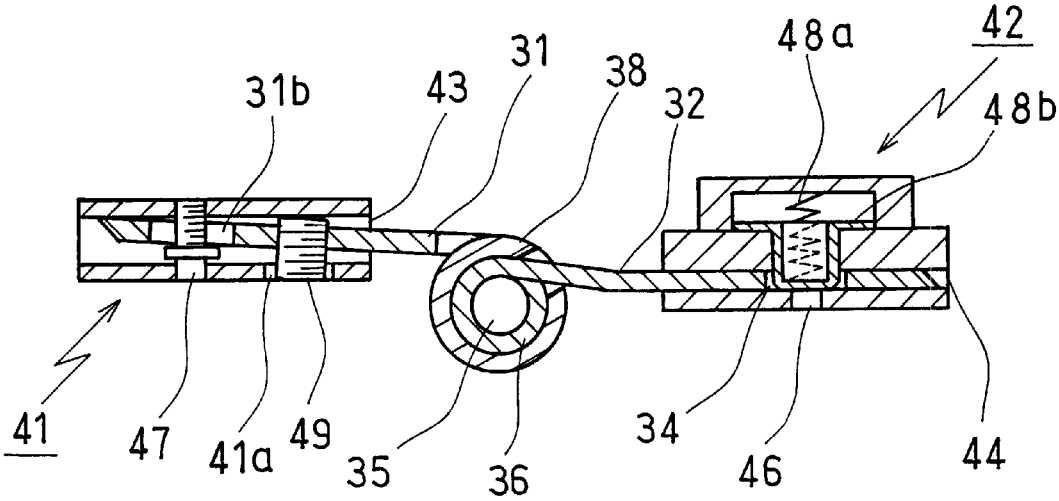
FIG. 11 is a sectional view of a hinge shown in FIG. 7 along line A—A in FIG. 9, wherein a second plate has been engaged with a hole of a door-side base member.

The lock apparatus is composed of an elastic projection, which is compressed by the second plate 32 inserted in the slit 44. The elastic projection extends into a hole 34, which is formed at the front end of the second plate 32, and it engages with the hole 34 as the second plate 32 continues to proceed in the slit 44 positioning the hole 34 to the opposed position in relative to the elastic projection. Specifically, as shown in FIGS. 10 and 11, the elastic projection comprises a spring 48*a* and a engaging member 48*b* which projects in the depth direction of the door-side base member 42 by an elastic force of the spring 48*a*. FIG. 10 illustrates the hinge 30 where the engaging member 48*b* is pressed backward as the spring 48*a* is compressed, while the engaging member 48*b* projects and engages with the second plate 32 as the spring 48*a* is allowed to extend into the hole 34 as shown in FIG. 11.

The top end of the engaging member 48*b* of the elastic projection is tapered in order to insert the second plate 32 into the slit 44 from both the front and back sides of the door 10. The elastic projection may be formed of a blade spring integrating functions of the spring 48*a* and the engaging member 48*b*.

As described above, it is possible to connect the second plate 32 whose top end is fixed to the frame-side base member 41 and the door-side base member 42 through one-touch operation.

The door-side base member 42 is provided with a hole 46 at a portion opposed to the engaging member 48*b* through the slit 44. In order to release the engaging member from the hole 46, the top edge of a stick such as a screwdriver 95 should be inserted into the hole 46, pushing the engaging member 48*b*. With such operation, the spring 48*a* is compressed and the engaging member 48*b* comes out of the hole 46.

Figure 12:
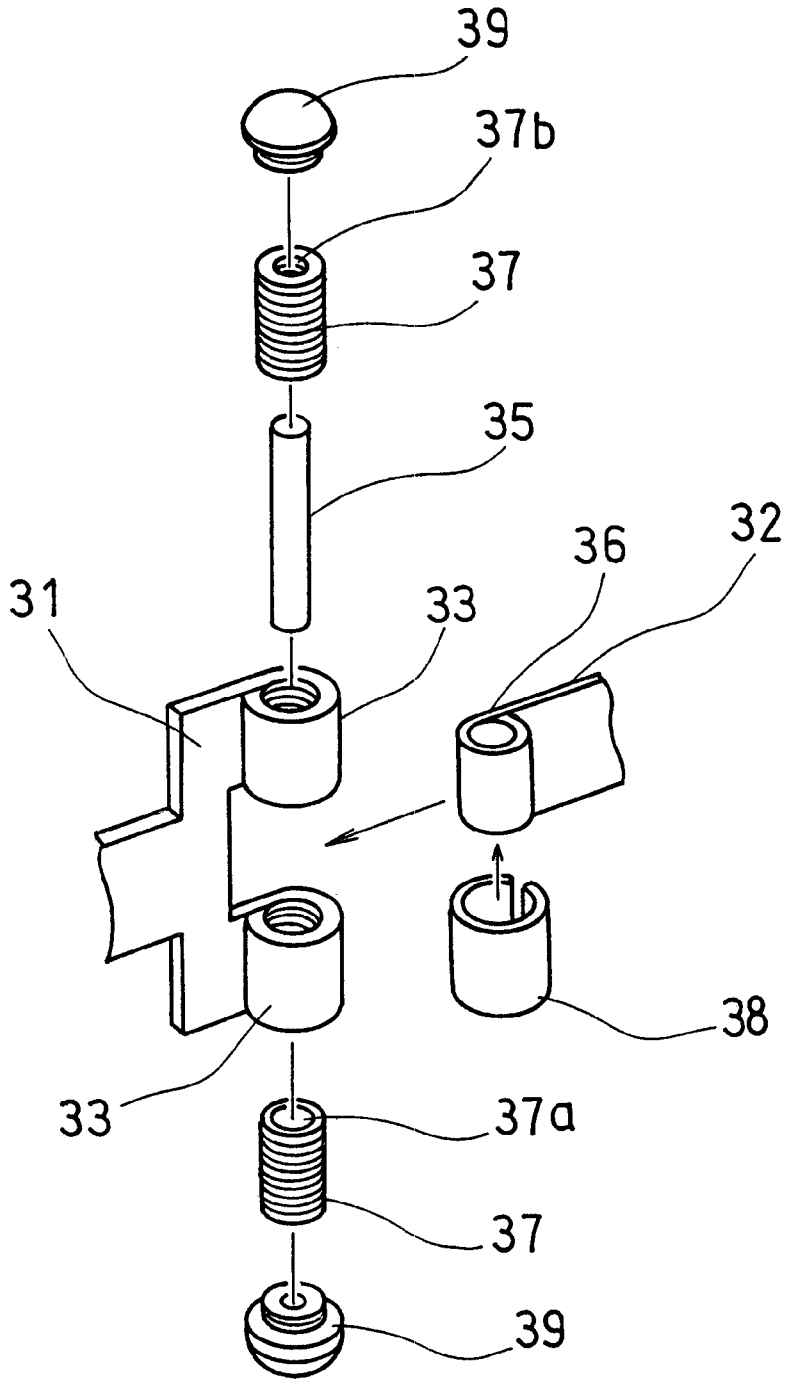
FIG. 12 is a exploded perspective view of a hinge shown in FIG. 7, showing a hinge structure composed of a first plate and second plate.

As illustrated in FIG. 12, there is provided a tubular member 36 at the rear end of the second plate 32. The tubular member 36 is fit in a collar 38 having a notch, and the tubular member 36 combined with the collar 38 is attached in between a pair of bearing members 33, 33 which is formed at the rear end of the first plate 31, via a vertical axis 35 capable of rotating. A pair of height-adjusting screws 37, 37 is screwed to the corresponding screws formed inside surfaces of the bearing members 33, 33, from above and below the vertical axis 35. Each of the height-adjusting screws 37 is provided with a concave 37*a* at the side thereof opposing the vertical axis 35 for receiving the axis 35, whereas the other side of the screw 37 is provided with a hole 37*b* for receiving a hexagonal wrench. Each height-adjusting screw 37 is arranged longer than the bearing member 33, and by moving the screw 37 upward or downward and pushing the tubular member 36 by the edge of the screw 37, the rear end of the second plate 32 moves upward or downward relative to the rear end of the first plate 31. Having such structure, the door 10 is fine adjusted in the vertical directions relative to the hinge-side vertical member 20. There is provided a decorative cap 37 on each height-adjusting screw 37.

Figure 9:
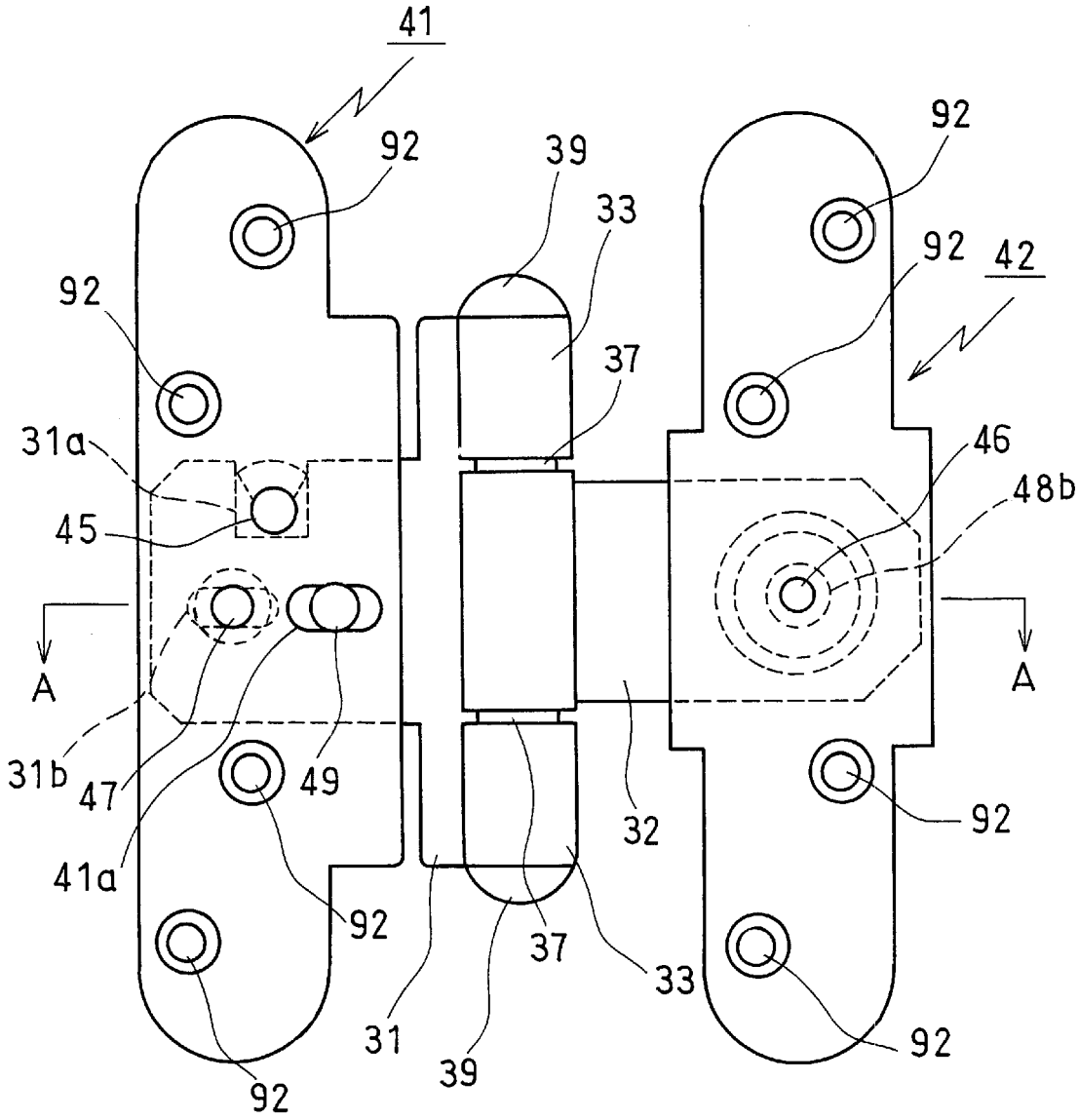
FIG. 9 is a elevation view of a hinge shown in FIG. 7, wherein a second plate has been inserted into a hole of a door-side base member.

The front end of the first plate 31 is inserted into a lengthwise-long hole 43 formed at the frame-side base member 41. As illustrated in FIG. 9, there is provided a pore space 31*a* at the upper portion of the front end of the first plate 31, to which an adjusting cam 45 provided to the frame-side base member 41 is placed. By rotating the adjusting cam 45, the first plate 31 shifts toward or backward the first plate 31. Composing such structure, the door 10 is fine adjusted in the back and forth direction (which is the depth direction of the door 10 when it is in a closed position) relative to the hinge-side vertical member 20. In place of the adjusting cam 45, there may be provided a groove at the side wall of the first plate 31 and an adjusting screw at the frame-side member 41, screwing the adjusting screw to the groove.

As illustrated in FIGS. 10 and 11, the width of the lengthwise-long hole 43 formed at the frame-side base member 41 to which the front end of the first plate 31 is inserted is formed wider than the thickness of the first plate 31 (In this embodiment, it is twice as wider than the thickness of the first plate), allowing the first plate 31 freely move in the directions along the thickness of the first plate 31 in the lengthwise-long hole 43. The top front end of the first plate 31 is fixed to the frame-side base plate 41 by a fixing screw 47, and an adjusting screw 49 is provided behind the fixing screw 47. By fixing the adjusting screw 49, the first plate 31 moves in the directions along the thickness of the first plate 31, while the portion of the first plate 31 fixed by the fixing screw 47 performs as a supporting point. Therefore, the door 10 is fine adjusted in the horizontal direction relative to the hinge-side vertical member 20 (that is a right angle relative to the depth and vertical directions of the door 10 when it is in a closed position). FIG. 10 illustrates a posture where the first plate 31 is pushed to the inside of the frame-side base member 41 (which is shown as an upper side in FIG. 10), thereby the side edge of the door 10 comes close to the frame-side base member 41. FIG. 11 illustrates a posture where the first plate 31 is pushed to the outside of the frame-side base member 31 (which is shown as a down side in FIG. 10), thereby the side edge of the door 10 comes apart from the frame-side base member 41 when the door 10 is closed.

Both the hole 31*b* of the first plate 31, through which the fixing screw 47 passes, and the hole 41*a* of the frame-side base member 41, through which the adjusting screw 49 passes, are formed long in sideways in order for the first plate 31 combined with the adjusting screw 49 to move close to or apart from the frame-side base member 41 when the fixing screw 47 is unscrewed and the adjusting cam 45 is fixed.

According to a hinge 30 composing such structure including the first plate 31 connected to the frame-side base member 41 and the second plate 32 connected to the first plate 31 in a hinge form, the combination of the frame-side base member 41, the first plate 31 and the second plate 32 is removable from the door-side base member 42 and it is easily attached to the door 10 from both the front and back sides of the door 10. Therefore, the hinge 30 can be applied for either the left-hinged or right-hinged door systems to meet needs in the fields. To meet needs in the fields, the frame-side base member 41 should be screwed to the hinge-side vertical member 20 accordingly.

Since the door-side base member 42 is flatly embedded at the side edge of the door 10, there is no projections at the front and back sides of the door 10, so that a packaged door 10 is as thin as the non-packaged bare door 10 in thickness. This leads an easy package of doors 10 while no cushioning materials are required to include.

As described in (A), (B), (C) and (D), the door system in the preferred embodiment is characterized in that: a pair of hinges 30 is respectively provided at a position which is symmetry about a phase that divides the hinge-side vertical member 20 into equal halves; the latch hole 52 of the latch receiving member 50 is formed at the position that divides the length of the latch-side vertical member 25 into equal halves; the latch 40 itself is capable of reversing, which is provided at the height equal to the latch hole 52 but higher than the door handle 90; and a pair of hinges 30 is attachable and detachable through one-touch operation. Therefore, such systematized door system is used as a double hinged door system, which leads to better productivity in door system industry.

We claim:

1. A double hinged door system comprising:

a door having a latch projecting therefrom, a door handle, and a latch driving apparatus which converts a rotation movement around an axis of the door handle into a forward-and-backward movement of the latch; and a door frame having a hinge-side vertical member and a latch side vertical member;

wherein:

said hinge-side vertical member is provided with at least a first hinge at an upper portion and a second hinge at a lower portion for enabling said door to rotate;

said latch-side vertical member comprises a latch receiving member having a latch hole for receiving the latch projecting from the door;

each hinge is positioned symmetrically about a mid-point of said hinge-side vertical member, and said latch hole of the latch receiving member is positioned at a point which divides the latch-side vertical member into equal halves;

said latch is arranged for rotation and comprises a front-end member having a large diameter and a rear-end member having a smaller diameter;

said latch is positioned at a level of the latch hole and higher than the axis of the door handle;

said front-end member of the latch is provided with a concave portion, and said rear-end member of the latch is provided with a thick portion;

a reversing spring is provided at an end of the latch to push the latch with an elastic force;

said rear-end member of the latch is adapted to be pulled out of the door against the elastic force of the reversing spring when a driving member is inserted into the concave portion and pulled, said latch is adapted to be reversed from side to side when said latch is pulled out of the door, and said latch is also adapted to be returned into the door in a reversed posture by the elastic force of the reversing spring when the driving member is released from the concave portion;

each hinge comprises (i) a frame-side base member which is attached to a hinge-side vertical member, and whose front end is connected with a first plate, and (ii) a door-side base member which is attached to an edge side of the door, and whose front end is connected with a second plate;

said second plate is removable from the door-side base member, and the door-side base member is embedded at an edge of the door so as to be symmetrical about a center line of the edge of the door and so as not to be projected from the edge of the door;

the door-side base member is provided with a slit in a depth direction of the door, and said slit is adapted to receive a front end of the second plate both from front and back sides of the door; and a lock apparatus is provided to engage with the second plate when the front end of the second plate is inserted into the slit.

2. A double-hinged door system as claimed in claim 1, wherein:

a rear end of the second plate is attached to the first plate, and is adapted to be moved upward and downward by adjusting screws;

a front end of the first plate is positioned in a long hole provided in the frame-side base member, and a width of the long hole is wider than a thickness of the first plate so that the first plate is capable of being moved in a depth direction within the long hole; and the front end of the first plate is connected to the frame-side base member so as to be capable of moving closer to and away from the frame-side base member by means of at least one of an adjusting screw and an adjusting cam.

3. A double-hinged door system as claimed in claim 1, wherein:

said second plate is provided with a hole at a center of the front end thereof;

said lock apparatus comprises an elastic projection which extends into said hole and engages therewith as said hole comes to a position opposing the elastic projection; and said elastic projection is adapted to be compressed in order to be disengaged from the hole.

4. A double-hinged door system as claimed in claim 2, wherein:

said second plate is provided with a hole at a center of the front end thereof;

said lock apparatus comprises an elastic projection which extends into said hole and engages therewith as said hole comes to a position opposing the elastic projection; and said elastic projection is adapted to be compressed in order to be disengaged from the hole.

* * * * *